US008567096B2

(12) United States Patent
Scholz

(10) Patent No.: US 8,567,096 B2
(45) **Date of Patent: *Oct. 29, 2013**

(54) MODULAR SHOE

(75) Inventor: Wolfgang Scholz, Lonnerstadt (DE)

(73) Assignee: adidas International Marketing B.V., Amsterdam (NL)

( * ) Notice: Subject to any disclaimer, the term of this patent is extended or adjusted under 35 U.S.C. 154(b) by 149 days.

This patent is subject to a terminal disclaimer.

(21) Appl. No.: 13/098,936

(22) Filed: May 2, 2011

(65) Prior Publication Data

US 2011/0203142 A1 Aug. 25, 2011

Related U.S. Application Data

(63) Continuation of application No. 12/769,825, filed on Apr. 29, 2010, now abandoned, which is a continuation of application No. 12/164,654, filed on Jun. 30, 2008, now Pat. No. 7,730,637, which is a continuation of application No. 11/064,439, filed on Feb. 23, 2005, now Pat. No. 7,406,781.

(30) Foreign Application Priority Data

Mar. 10, 2004 (DE) ..... 10 2004 011 680

(51) Int. Cl.
*A43C 15/02* (2006.01)

(52) U.S. Cl.
USPC ..... 36/67 D; 36/134

(58) Field of Classification Search
USPC ..... 36/67 D, 134, 129
See application file for complete search history.

(56) References Cited

U.S. PATENT DOCUMENTS

| | | | |
|---|---|---|---|
| 1,141,889 | A | 6/1915 | Trolle |
| 1,493,856 | A | 5/1924 | Golden |
| 1,778,089 | A | 10/1930 | Pomerantz |
| 1,841,710 | A | 1/1932 | Byrne et al. |
| 1,982,588 | A | 11/1934 | Bartel |
| 2,040,186 | A | 5/1936 | Riddell |
| 2,082,537 | A | 6/1937 | Butler |
| 2,095,095 | A | 10/1937 | Howard |
| 2,095,766 | A | 10/1937 | Shapiro |
| 2,183,277 | A | 12/1939 | Heilhecker |

(Continued)

FOREIGN PATENT DOCUMENTS

| | | |
|---|---|---|
| DE | 2216252 | 4/1972 |
| DE | 20208713 | 6/2002 |
| WO | 87/05192 | 9/1987 |

OTHER PUBLICATIONS

Protest Under 37 CFR 1.1291, Group 3728 filed Nov. 13, 2007, 8 pages.

(Continued)

*Primary Examiner* — Ted Kavanaugh
(74) *Attorney, Agent, or Firm* — Kilpatrick Townsend & Stockton LLP

(57) ABSTRACT

A modular shoe includes an upper with an upper side and a lower side, a chassis releasably arranged in an interior of the upper, and a plurality of studs. Each stud is releasably attached to the chassis through the lower side of the upper. The lower side of the upper is clamped between the chassis and at least one of the attached studs. The invention also relates to the various components used in a modular shoe in accordance with the invention.

14 Claims, 3 Drawing Sheets

(56) References Cited

U.S. PATENT DOCUMENTS

| | | | |
|---|---|---|---|
| 2,207,476 | A | 7/1940 | Bernstein |
| 2,260,138 | A | 10/1941 | Feinberg |
| 2,368,314 | A | 1/1945 | Marx |
| 2,817,165 | A | 12/1957 | Dassler |
| 3,127,687 | A | 4/1964 | Hollister et al. |
| 3,526,976 | A | 9/1970 | Jacobs |
| 3,538,628 | A | 11/1970 | Einstein |
| 3,597,863 | A | 8/1971 | Austin et al. |
| 3,685,174 | A | 8/1972 | Artle, Jr. et al. |
| 3,686,779 | A | 8/1972 | Sachs |
| 3,735,507 | A | 5/1973 | Granger |
| 3,775,873 | A | 12/1973 | Small |
| 3,812,605 | A | 5/1974 | Kaestle et al. |
| 3,822,488 | A | 7/1974 | Johnson |
| 3,846,919 | A | 11/1974 | Milotic et al. |
| 3,859,739 | A | 1/1975 | Dassler et al. |
| 3,866,339 | A | 2/1975 | Latto |
| 3,878,626 | A | 4/1975 | Isman et al. |
| 3,906,646 | A | 9/1975 | Milotic et al. |
| 3,911,600 | A | 10/1975 | Dassler et al. |
| 3,967,392 | A | 7/1976 | Dassler et al. |
| 3,982,336 | A | 9/1976 | Herro |
| 4,103,440 | A | 8/1978 | Lawrence |
| 4,107,857 | A | 8/1978 | Devlin |
| 4,107,858 | A | 8/1978 | Bowerman et al. |
| 4,267,650 | A | 5/1981 | Bauer |
| 4,299,038 | A | 11/1981 | Epple et al. |
| 4,314,412 | A | 2/1982 | Anderson et al. |
| 4,317,294 | A | 3/1982 | Goodyear |
| 4,361,971 | A | 12/1982 | Bowerman |
| 4,366,632 | A | 1/1983 | Bente et al. |
| 4,409,745 | A | 10/1983 | Musci et al. |
| 4,414,763 | A | 11/1983 | Bente et al. |
| 4,439,935 | A | 4/1984 | Kelly |
| 4,470,207 | A | 9/1984 | Bente et al. |
| 4,633,600 | A | 1/1987 | Dassler et al. |
| 4,644,672 | A | 2/1987 | Dassler et al. |
| 4,648,187 | A | 3/1987 | Dassler et al. |
| 4,706,392 | A | 11/1987 | Yang et al. |
| 4,875,300 | A | 10/1989 | Kazz |
| 4,949,476 | A | 8/1990 | Anderie |
| 5,083,385 | A | 1/1992 | Halford et al. |
| 5,206,804 | A | 4/1993 | Thies et al. |
| 5,282,288 | A | 2/1994 | Henson |
| 5,317,822 | A | 6/1994 | Johnson |
| 5,339,252 | A | 8/1994 | White et al. |
| 5,339,543 | A | 8/1994 | Lin et al. |
| 5,339,544 | A | 8/1994 | Caberlotto et al. |
| 5,351,421 | A | 10/1994 | Miers et al. |
| 5,361,133 | A | 11/1994 | Brown et al. |
| 5,361,518 | A | 11/1994 | Sussmann et al. |
| 5,367,791 | A | 11/1994 | Gross et al. |
| 5,410,821 | A | 5/1995 | Hilgendorf |
| 5,533,280 | A | 7/1996 | Halliday |
| 5,600,901 | A | 2/1997 | Leonor |
| 5,615,497 | A | 4/1997 | Meschan |
| 5,644,857 | A | 7/1997 | Ouellette et al. |
| 5,659,395 | A | 8/1997 | Brown et al. |
| 5,661,915 | A | 9/1997 | Smith |
| D387,892 | S | 12/1997 | Briant et al. |
| D389,298 | S | 1/1998 | Briant et al. |
| 5,714,098 | A | 2/1998 | Potter |
| 5,732,484 | A | 3/1998 | Grutza et al. |
| 5,743,029 | A | 4/1998 | Walker et al. |
| 5,832,636 | A | 11/1998 | Lyden et al. |
| 5,879,725 | A | 3/1999 | Potter |
| 5,915,820 | A | 6/1999 | Kraeuter et al. |
| 5,970,630 | A | 10/1999 | Gallegos |
| 5,979,083 | A | 11/1999 | Robinson et al. |
| 5,987,783 | A | 11/1999 | Allen et al. |
| 6,009,641 | A | 1/2000 | Ryan |
| 6,016,613 | A | 1/2000 | Campbell et al. |
| 6,023,859 | A | 2/2000 | Burke et al. |
| 6,032,386 | A | 3/2000 | Evans |
| 6,050,006 | A | 4/2000 | Swindle |
| 6,092,311 | A | 7/2000 | MacNamara |
| 6,112,433 | A | 9/2000 | Greiner et al. |
| 6,113,123 | A | 9/2000 | Cabanis et al. |
| 6,115,947 | A | 9/2000 | Swindle |
| 6,145,221 | A | 11/2000 | Hockerson |
| 6,170,177 | B1 | 1/2001 | Frappier et al. |
| 6,256,907 | B1 | 7/2001 | Jordan et al. |
| 6,301,806 | B1 | 10/2001 | Heller et al. |
| 6,345,454 | B1 | 2/2002 | Cotton |
| 6,357,146 | B1 | 3/2002 | Wordsworth et al. |
| 6,389,712 | B1 | 5/2002 | Schelling |
| 6,421,937 | B2 | 7/2002 | Heller et al. |
| 6,442,870 | B1 | 9/2002 | Tsai et al. |
| 6,449,235 | B1 | 9/2002 | Kim et al. |
| 6,449,878 | B1 | 9/2002 | Lyden |
| 6,463,681 | B1 | 10/2002 | Savoie |
| 6,568,101 | B1 | 5/2003 | Jansen et al. |
| 6,581,255 | B2 | 6/2003 | Kay |
| 6,601,042 | B1 | 7/2003 | Lyden |
| 6,748,677 | B2 | 6/2004 | Briant et al. |
| 6,823,613 | B2 | 11/2004 | Kelly et al. |
| 6,915,597 | B2 | 7/2005 | Jungkind et al. |
| 6,948,264 | B1 | 9/2005 | Lyden |
| 6,957,503 | B2 | 10/2005 | De Paoli et al. |
| 6,983,553 | B2 | 1/2006 | Lussier et al. |
| 6,986,183 | B2 * | 1/2006 | Delgorgue et al. ..... 36/45 |
| 7,016,867 | B2 | 3/2006 | Lyden |
| 7,047,676 | B2 | 5/2006 | Nicholson et al. |
| 7,107,235 | B2 | 9/2006 | Lyden |
| 7,225,565 | B2 | 6/2007 | DiBenedetto et al. |
| 7,353,527 | B2 | 4/2008 | Preis et al. |
| 7,401,422 | B1 | 7/2008 | Scholz et al. |
| 7,406,781 | B2 | 8/2008 | Scholz |
| 7,730,637 | B2 | 6/2010 | Scholz |
| 2002/0100190 | A1 | 8/2002 | Pellerin |
| 2002/0178613 | A1 | 12/2002 | Williamson et al. |
| 2002/0184795 | A1 | 12/2002 | Kan |
| 2003/0069807 | A1 | 4/2003 | Lyden |
| 2005/0198868 | A1 | 9/2005 | Scholz |
| 2008/0263904 | A1 | 10/2008 | Scholz |
| 2010/0212192 | A1 | 8/2010 | Scholz |

OTHER PUBLICATIONS

Second Protest Under 37 CFR 1.1291, Group 3728 filed Apr. 14, 2008, 13 pages.

Protest Under 37 CFR 1.1291, Group 3728 filed Oct. 28, 2009, 19 pages.

Adidas Adistar track shoes, available at least as early as Dec. 5, 2007, 2 photos.

http://adidas.freehomepage.com/technology_timeline.html, available at least as early as Nov. 12, 2007, 3 pages.

* cited by examiner

MODULAR SHOE

CROSS-REFERENCE TO RELATED APPLICATION

This application is a continuation of U.S. application Ser. No. 12/769,825, filed Apr. 29, 2010, which is a continuation of U.S. application Ser. No. 12/164,654, filed on Jun. 30, 2008; now U.S. Pat. No. 7,730,637, which is a continuation of U.S. application Ser. No. 11/064,439, filed on Feb. 23, 2005, now U.S. Pat. No. 7,406,781, which claims priority to and the benefit of German patent application serial number 102004011680.6, filed on Mar. 10, 2004, the entire disclosures disclosure of which are hereby incorporated herein by reference.

TECHNICAL FIELD

The present invention relates to a modular shoe and components therefor.

BACKGROUND OF THE INVENTION

Similar to other sports shoes, studded shoes, such as soccer shoes, are currently mass produced. During the early days of the game of soccer, the shoes were individually manufactured by a craftsman. The shoemaker did not only take the specific anatomy of the player into account, but also his preferences concerning, for example, the selection of material or the outer design of the shoe. Apart from being provided in a series of predetermined sizes, mass produced soccer shoes have, however, generally the same properties, such as color, shape, hardness of the sole, etc. An individual adaptation to anatomic requirements and aesthetic preferences of the player is, if at all, only possible to a limited extent.

Several approaches are known in the prior art to provide exchangeable studs that allow a wearer to adapt the gripping properties of a studded shoe to changing ground conditions. As an example, screw studs are mentioned, wherein the stud includes a screw-like projection that is releasably screwed into the threads of the shoe sole.

Apart from the exchange of studs, options for the individual adaptation of a studded shoe, such as a soccer shoe, are lacking. On the contrary, the prior art teaches that a studded shoe, which is subjected to high mechanical loads during use, has to be provided as a compact and stable arrangement of permanently interconnected components (sole, upper, etc.). Only the studs can be replaced in the described manner. Optionally, an additional inlay sole may be used. Properties, such as the shape, the hardness, and the weight of the sole, as well as properties of the upper, such as the lacing system, ventilation properties or—in case of soccer shoes—structural elements on the upper for improving the accuracy of a shot, are not modifiable. This distinguishes studded shoes fundamentally from certain other types of shoes, for example dress shoes for women, for which a kind of toolbox system is known from German patent no. DE 202 08 713 U1, the disclosure of which is hereby incorporated herein by reference in its entirety.

It has been found, however, that there is a considerable need for the ability to individualize studded shoes to a greater extent, either due to biomechanical requirements or for accommodating the aesthetic preferences of a player. There is, therefore, a need for a studded shoe having a different and better construction than known in the prior art, the shoe being adaptable to the individual requirements and preferences of a player.

SUMMARY OF THE INVENTION

This problem is solved by a modular studded shoe including at least three essential modules or components. The first module is an upper that, in one embodiment, is shaped like a sock and encompasses a wearer's foot from all sides. In contrast to known studded shoes, however, the upper is not permanently glued, welded, or stitched to an outsole or a similar sole layer. Instead, a releasable chassis is arranged as a second module in an interior region of the upper. In one embodiment, the chassis loosely contacts, without attachment to, an interior portion of a lower side of the upper. A stable studded shoe is created by the interconnection of the third module, a plurality of studs that are attached through the lower side of the upper to the chassis. The lower side of the sock-like upper is preferably clamped between the chassis and at least one of the plurality of attached studs.

The described modular construction of a studded shoe leads to a great number of advantages for both the manufacturer and the athlete. The unlimited combinations of various embodiments of the three releasably combined modules (i.e., the upper, the chassis, and the studs) allow the manufacturer or the athlete or both to modify the design and the technical properties of the studded shoe over a wide range of possible characteristics. For example, the replacement of the sock-like upper allows the use of uppers with different colors and patterns, as well as the use of thicker or thinner embodiments depending on the season. Even a complete individualization is possible by imprinting the upper with a pattern or lettering unique to the individual athlete, for example a signature. It is also possible to use different materials for the upper, which lead to different properties during ball contact with the instep.

The releasable chassis generally determines the mechanical properties of the studded shoe. For example, it is possible to use, depending on the ground conditions, a chassis of a different hardness. Furthermore, the thickness and contour of the chassis can influence the positioning of the foot inside the shoe. In another embodiment of the invention, the shape of the upper side of the chassis can be custom made in accordance with the wearer's foot, for example, as determined by a three-dimensional scan. Also, the material properties of the chassis may be customized to take the individual needs of a wearer into account, for example to provide pronation control or increased cushioning.

The shape and arrangement of the studs determine the gripping properties of the studded shoe. In contrast to the prior art, the attachment of the studs provides additionally a rigid, but releasable, interconnection between the three modules of the studded shoe, i.e., the upper, the chassis, and the studs. It has been found that a studded shoe having the above described modular design has, in contrast to the above-mentioned prejudice in the prior art, the necessary stability to permanently withstand the loads arising during running and shooting a ball.

From the viewpoint of the manufacturer, the described modular design facilitates the production of the studded shoe. Instead of a complete shoe, only three modules are produced, which are later selected and assembled by the customer. Gluing, welding, or sewing the components of the shoe is no longer necessary, which reduces the number of production steps. Furthermore, there are no toxic solvent vapors involved in the manufacture of the shoe, which are typically a problem with respect to the environment.

In one aspect, the invention relates to a modular article of footwear. The article of footwear includes an upper having a lower side, a chassis releasably disposed in an interior of the upper, and a plurality of studs. Each stud is releasably attached to the chassis through an aperture formed in the lower side of the upper. The lower side of the upper can be clamped between the chassis and at least one of the mounted studs. The interior of the upper can be defined by an upper side of the upper.

In various embodiments, the upper optionally includes a reinforcement element disposed on at least one of a heel part or a toe part. This avoids premature abrasion of the upper in these parts, which are subjected to greater wear. The lower side of the upper can include a coating for resisting adhesion of dirt. Such coatings are today well-known from many fields of technology. In one embodiment, the article of footwear includes a seal at least partially disposed between the studs and the lower side of the upper for preventing penetration of dirt into the interior of the upper through the apertures formed in the lower side. The seal can be disposed along an upper rim of each of the plurality of studs. Thus, the opening in the lower side of the upper through which one or more studs are releasably attached to the chassis is effectively sealed against moisture or dirt particles on the playing field. Known stud systems, wherein the mounting mechanism is arranged outside of the interior of the upper, generally do not include such a sealing arrangement.

Further, the stud can include a first mounting means that corresponds in shape and mates with a second mounting means of the chassis. The stud is thereby secured against rotation when attached to the chassis. In one embodiment, the first mounting means and the second mounting means can include an oblong recess engaged by a mating projection, where the recess can be located in either the first mounting means or the second mounting means with the mating projection disposed on the corresponding mounting means. In another embodiment, the first mounting means includes a screw for engaging threads in the second mounting means. The screw can extend beyond an exterior portion of the stud. In various embodiments, the at least one stud has an oblong shape and several oblong studs can be disposed on the chassis and secured against rotation, the studs having differing orientations with respect to the chassis.

In another aspect, the invention relates to a stud for an article of footwear for releasably interconnecting an upper and a chassis. The stud includes a stud body for penetration of ground, a first mounting means adapted for interacting with a second mounting means of the chassis releasably disposable inside the upper, and a seal for sealing an interior of the upper on a lower side thereof. Due to its sealing, such a stud is particularly adapted to be used in connection with the above described modular studded shoe, since moisture and dirt cannot reach the interior of the upper. In various embodiments, the first mounting means corresponds in shape and mates with the second mounting means of the chassis. The stud is secured against rotation when attached to the chassis. The first mounting means can include at least one of an oblong recess or a corresponding projection. In one embodiment, the first mounting means includes a screw that extends beyond an exterior portion of the stud. The screw can extend beyond the stud body in a downward direction. The first mounting means of the stud can be designed to correspond in shape, so that it can mate with the second mounting means of the chassis. As a result, the stud can be attached to the chassis in a manner secured against rotation. To this end the stud body, in one embodiment, includes an oblong recess that can be engaged by a corresponding projection of the second mounting means.

In another aspect, the invention relates to a chassis for an article of footwear for releasably interconnecting an upper and a plurality of studs. The chassis includes a plurality of projections adapted to extend through a plurality of corresponding apertures in a lower side of the upper. In various embodiments, the shape of the projections can be a combination of polygonal and arcuate shapes; however, the shape could be polygonal, arcuate, or any combination thereof. In the present application, the term polygonal is used to denote any shape including at least two line segments, such as rectangles, trapezoids, triangles, etc. In one embodiment, the projection has a generally oblong shape and extends horizontally with respect to the article of footwear. In one example, the projection extends generally parallel to a longitudinal axis of the article of footwear.

In various embodiments, the plurality of projections is adapted to correspond in shape and mate with corresponding recesses in a plurality of studs. In one embodiment, the plurality of projections have differing orientations with respect to the chassis. At least one end of the projections can be tapered. Additionally, the projections can include threads formed therein. Alternatively or additionally, the chassis can include recesses for mating with projections located on at least some of the studs.

In another aspect, the invention relates to an upper for an article of footwear for releasably interconnecting a chassis and a plurality of studs. The upper includes a lower side adapted to at least partially extend below a wearer's foot and a plurality of apertures formed through the lower side for receiving a plurality of corresponding projections of the chassis. The shape of the apertures can be polygonal, arcuate, or combinations thereof. In various embodiments, the upper optionally includes a reinforcement element disposed on at least one of a heel part or a toe part. The lower side can include a coating to reduce adhesion of dirt to the lower side of the upper.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Embodiments of the present invention are described below. It is, however, expressly noted that the present invention is not limited to these embodiments, but rather the intention is that modifications that are apparent to the person skilled in the art are also included. In particular, the present invention is not intended to be limited to a soccer shoe, but rather it is to be understood that the present invention can also be used for other types of studded shoes, such as spiked track and field shoes and footwear used for grass and turf-based sports, such as golf, rugby, hockey, football, and baseball, as well as climbing or the like. Further, only a left shoe is depicted in any given figure; however, it is to be understood that the left and right shoes are typically mirror images of each other and the description applies to both left and right shoes. In certain activities that require different left and right shoe configurations or performance characteristics, the shoes need not be mirror images of each other.

Figure 1A:
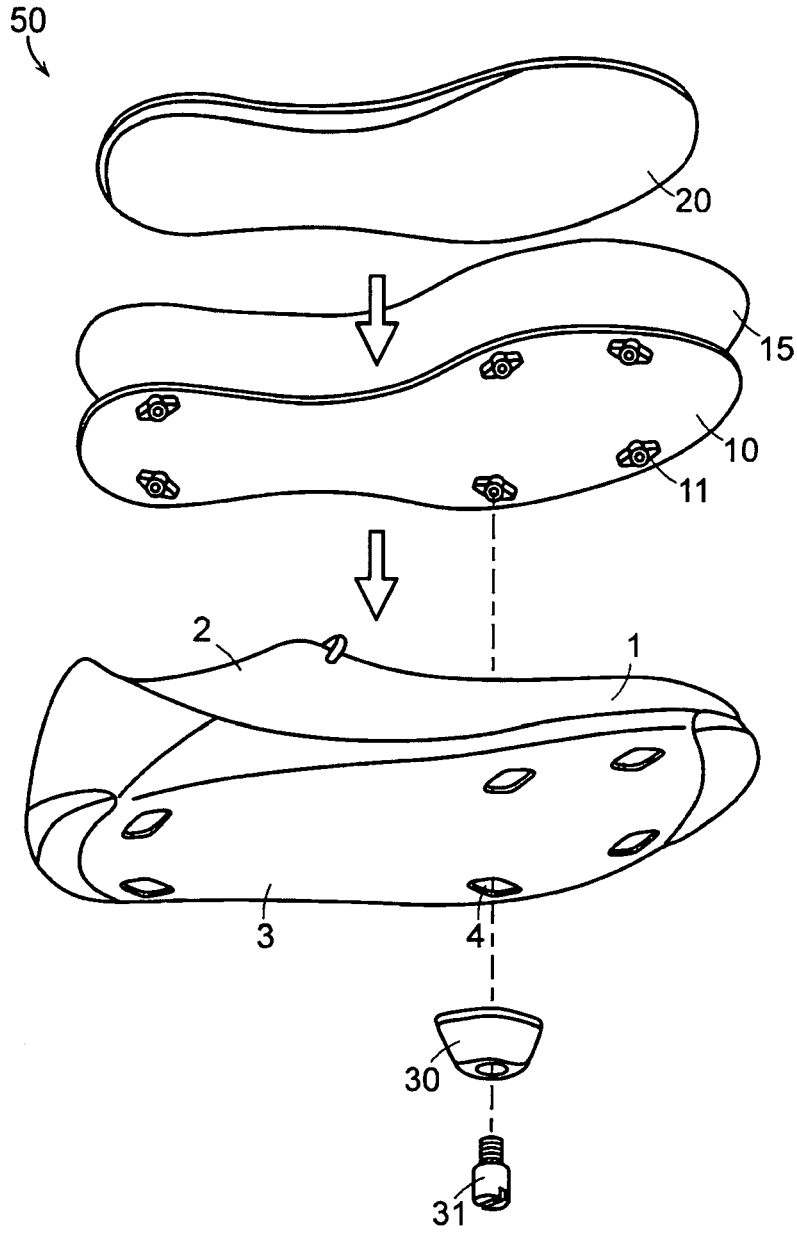
FIG. 1A is an exploded perspective view of various components of a modular studded shoe in accordance with one embodiment of the invention.

FIG. 1A shows an exploded view of a modular studded shoe 50 in accordance with a particular embodiment of the invention for use in playing soccer. A chassis 10 is arranged in an interior region of a flexible upper 1 (see FIG. 1B). Further sole layers may be arranged on top of the chassis 10, for example an insole 20, as shown in FIG. 1A. In one embodiment, the insole 20 is made from a foamed material such as ethylene vinyl acetate (EVA) or polyurethane (PU) for cushioning. Further, it is possible to arrange additional sole layers within the upper 1 above or below the chassis 10. The sole layers need not be connected to each other and may be only loosely arranged on top of each other in the interior of the upper 1. A preliminary fixation of the sole layers with respect to each other is, however, also possible by, for example, using one or more hook and loop fasteners (such as those sold under the trade name Velcro®). Alternatively, it is also possible to combine two or more elements, such as the chassis 10 and an additional sock-liner 15 into a single element.

The upper 1 forms the above-mentioned interior by including an upper side 2 as well as a lower side 3, which combined at least partly encompasses a wearer's foot like a sock. Several openings 4 are provided in the lower side 3. The arrangement of these openings corresponds to the distribution of a plurality of separately arranged studs 30 on the lower side 3. As indicated by the dashed line in FIG. 1A, each stud 30 is releasably, but rigidly, interconnected to the chassis 10, in one embodiment, by means of a screw 31 extending through one of the apertures or openings 4 in the lower side of the upper 1. Apart from the use of a screw 31, other mounting means are contemplated and within the scope of the invention, for example a clipping connection as described in U.S. Pat. No. 6,748,677 or a magnetic attachment as described in U.S. patent application Ser. No. 10/654,277, the entire disclosures of which are hereby incorporated herein by reference. The number, arrangement, and type of studs will vary to suit a particular application and may be located anywhere on the lower side of the upper or, for example, only in a forefoot region thereof.

Figure 1B:
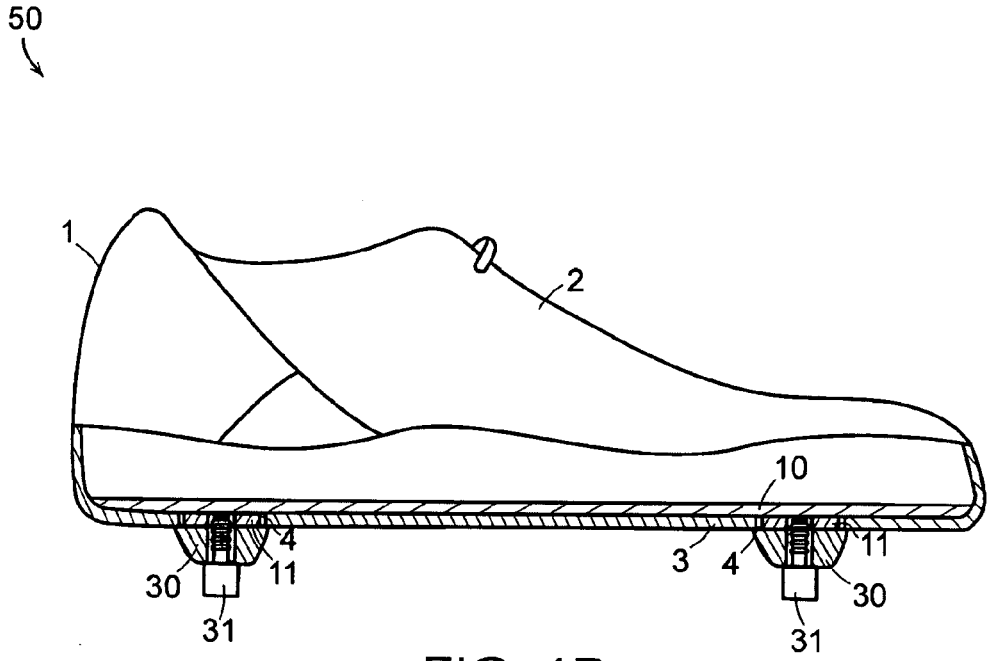
FIG. 1B is a schematic cross-sectional view of the assembled modular studded shoe of FIG. 1A.

Furthermore, as shown in FIG. 1B, the chassis 10 is disposed on the lower side 3 of the upper 1 and the projections 11 extend through the openings 4 in the lower side 3 and are substantially flush with the lower side 3 of the upper 1. All or any number of the projections 11 may be flush with, partially recessed, or extend beyond the lower side 3 of the upper 1, as necessary to mate with a corresponding stud. For example, the projections 11 in the forefoot region may extend beyond the lower side 3 of the upper 1 to mate with one type of stud, while the projections 11 in the rearfoot region may be partially recessed for mating with a different type of stud.

Due to the attachment of the plurality of studs 30 to the chassis 10, the modular soccer shoe 50 obtains the required stability. Any additional sole layers disposed between the chassis 10 and the stud 30 are held in place together with the lower side 3 of the upper 1, which is, in the embodiment shown in FIG. 1A, directly clamped between the stud 30 and the chassis 10. As a result, a soccer shoe 50 is obtained (FIG. 1B), which is on the one hand modular and which has on the other hand the same stability as a conventionally manufactured soccer shoe made from a plurality of permanently interconnected components.

In addition to the upper 1, additional elements of the shoe may be held in place between the studs 30 and the chassis 10, for example, an external torsion bar, an external heel counter, and/or an exchangeable sole plate disposed below the upper 1 to protect against abrasion. These optional shoe elements are also removable and, therefore, customizable similar to the studs 30 and the chassis 10.

The chassis 10 provides the necessary stability for the shoe, i.e., this module forms the "spine" for the overall shoe. It is, therefore, desirable to make the chassis from stable plastic materials, such as thermoplastic polyurethane (TPU) or from carbon fibers. In one embodiment, the chassis 10 can be manufactured out of substantially compression resistant plastic materials, which have the advantage of withstanding the mechanical loads arising during contact of the shoe with the ground and also have the required flexibility not to hinder movements of the foot, such as those that occur during the rolling-off and pushing-off phase of the gait cycle. It is also possible to use a thin metal plate or a composite material. Since the chassis is an exchangeable module of the overall soccer shoe, the player can alter the mechanical properties of the shoe by using a different chassis according to his needs and/or the environmental conditions. For example, it is possible to produce several chassis having different hardnesses or different weights in order to meet these requirements. Further, variations in the shape of the chassis (in the case of an identical shoe size) are possible, for example to adapt to narrower or wider feet or the provision of a plurality of chassis with different flex zones. Accordingly, the chassis can have grooves, apertures, cut-outs, or other features formed therein to provide tailored flexibility or preferential mechanical properties in predetermined zones or areas of the shoe.

Figure 2:
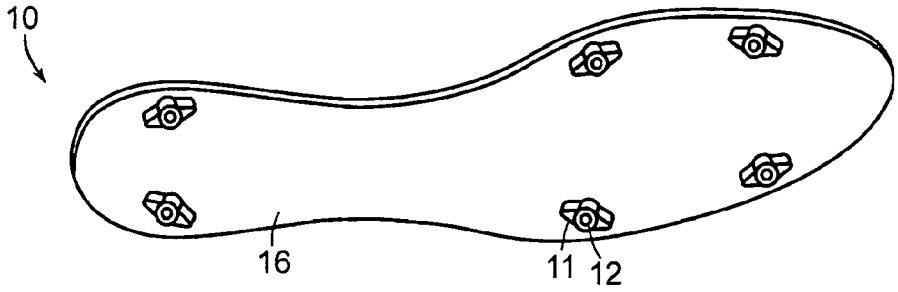
FIG. 2 is a schematic perspective view of a chassis for use in a modular shoe in accordance with one embodiment of the invention.

The chassis 10, which is shown enlarged in FIG. 2, includes on its lower side 16 a plurality of mounting means that are provided, in one embodiment, as oblong projections 11. The projections 11 extend through the openings 4 in the lower side 3 of the upper 1 and serve as mating structures for anchoring the studs 30. The shape of these projections 11 corresponds substantially to the shape of the openings 4. As a result, the chassis 10 is, during assembly of the modular soccer shoe, preliminary maintained in the correct position even before the attachment of the studs 30. In a particular embodiment, at least one end of the projections 11 and the openings 4 are tapered, wherein sufficient clearance is provided so that the projections 11 can easily penetrate the openings 4.

The studs 30 are attached to the projections 11. In one embodiment, each stud 30 includes a recess that corresponds in shape, so that it can mate with the respective projection 11 of the chassis 10, thus securing the stud 30 to the chassis 10 to prevent rotation of the stud 30 with respect to the chassis 10. This is particularly desirable where the studs used are not rotationally symmetric, but which are oblong or asymmetric, so that a correct orientation is achieved. This is shown in FIG.

2, where it can be seen that the oblong projections 11 have a different orientation depending on their position on the chassis 10.

Figure 3:
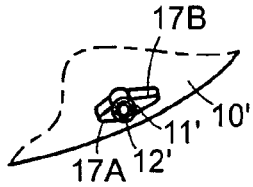
FIG. 3 is a partial schematic perspective view of an alternative mounting projection of a chassis for use in a modular shoe in accordance with one embodiment of the invention.

Furthermore, it is also possible to individually design the projections 11 so that only one stud 30 fits to a corresponding projection 11. This is desirable where the studs 30 are not only differently oriented at different positions of the chassis 10, but also have individual shapes. The use of numbers or color coding can facilitate the assignment of studs 30 to projections 11 during assembly of the modular soccer shoe. FIG. 3 shows an alternative embodiment of a projection 11', which unambiguously defines the orientation of the corresponding stud due to its shoulders 17A, 17B of different lengths (see also FIG. 5A). In some embodiments, metallic threads 12, 12' can be arranged in, for example, the center of each projection 11, 11'. The threads 12, 12' can be engaged by the screw 31 of the stud 30. In one embodiment, each screw 31 can extend through a recess in the stud, which can be either threaded or non-threaded.

A further embodiment is also possible, where the chassis 10 does not include projections, but instead, each stud 30 has an upper projection extending through the opening 4 on the lower side 3 of the upper 1 and engaging a recess in the chassis 10. The recess is designed to correspond in shape, so that it can mate with the projection of the stud 30. In this embodiment, a sufficient stability of the shoe 50 is similarly assured by clamping the lower side 3 of the upper 1 of the shoe 50 between the stud 30 and the chassis 10. In a further embodiment, neither the chassis 10 nor the stud 30 includes a projection. Only the screw 31 or another mounting means penetrates the opening 4 and anchors the stud 30 to the chassis 10. Such a simplified embodiment is, for example, desirable for rotationally symmetric screw studs, as shown for example in FIG. 5B, where it is not necessary to affix the stud 30 in a certain orientation, due to its symmetric shape.

Figure 4:
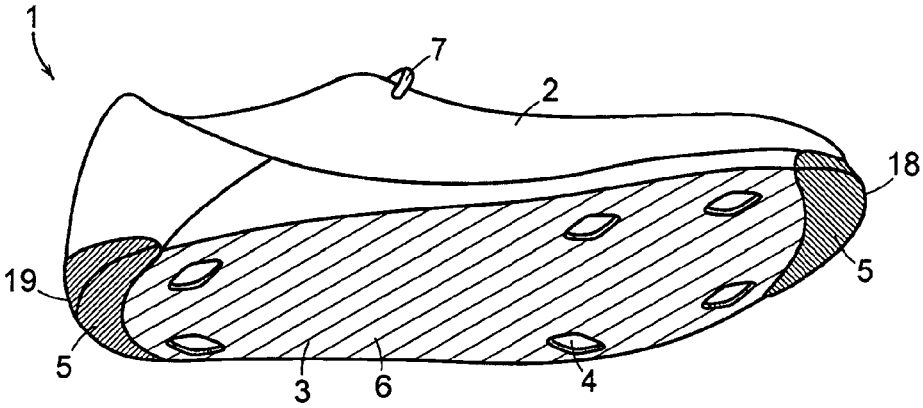
FIG. 4 is a schematic perspective view of an upper for use in a modular shoe in accordance with one embodiment of the invention.

FIG. 4 depicts one possible embodiment of the upper 1. This module can be generally similar to a common upper of a shoe. Known materials, such as (artificial) leather, a fabric, net materials, or the like may be used. Although FIG. 4 shows a continuous upper, the upper side 2 of the upper 1 may also include a plurality of openings, for example for ventilation. Using laces 7 or other means, the upper 1 can be retained securely on the wearer's foot.

Known uppers, however, typically only encompass the foot from above and on the sides. The upper 1 in accordance with the invention includes a lower side 3 that at least partly encompasses the foot from below. As a result, the upper 1 has a sock-like shape. Apart from the already mentioned openings 4 for attaching the studs 30, the lower side 3 may have further openings, for example for an improved ventilation of the interior of the shoe. One example of openings for ventilation can be found in U.S. Pat. No. 6,817,112, the entire disclosure of which is hereby incorporated herein by reference.

FIG. 4 shows additional optional reinforcing elements 5 disposed on a front or toe part 18 and a rear or heel part 19 of the upper 1 of the shoe 50. Premature abrasion of these regions of the upper 1, which are subjected to great wear, is thereby avoided. The reinforcing elements 5 may be plastic materials, such as TPU, that are glued or injected onto the upper 1 or additional material layers that are sewn onto the upper 1 or connected thereto by any other method. The reinforcing elements 5 can be located on only one of the toe part 18 and heel part 19, or at any other region of the upper 1 subjected to greater wear due to the use of the shoe.

Furthermore, the exterior of the lower side 3 of the upper 1 can include an optional coating 6 that serves to resist the adhesion of dirt. This coating 6 may, for example, be made from polytetrafluoroethylene (PTFE) based materials, such as those sold under the trademark Teflon®. In FIG. 4, this coating 6 is schematically indicated by the coarse hatch on the lower side 3 of the upper 1. Furthermore, it is possible to protect not only the ends of the lower side 3, but also other regions of the upper 1 against premature wear by use of an abrasion-resisting coating.

Figure 5A:
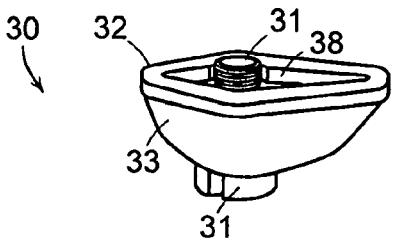
FIGS. 5A and 5B are schematic perspective views of studs for use with a modular shoe in accordance with alternative embodiments of the invention.
Figure 5B:
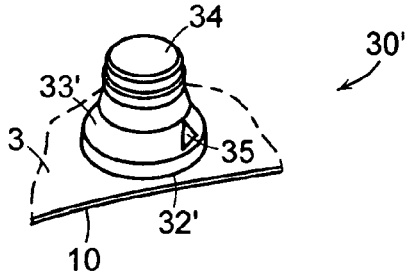

FIGS. 5A and 5B depict examples of possible embodiments of studs 30, where FIG. 5A depicts an oblong stud 30 and FIG. 5B depicts a rotationally symmetric stud 30'. The stud 30' of FIG. 5B is shown inverted and attached to the chassis 10. Both studs 30, 30' can include a seal 32, 32' that contacts the lower side 3 of the upper 1, when mounted. Due to the contact pressure of the stud 30, 30' against the chassis 10, and thereby against the clamped lower side 3 of the upper 1, the seal 32, 32' is slightly compressed and reliably seals the opening 4 against the penetration of moisture and dirt. This seal 32, 32' can, for example, be provided as a circumferential sealing lip, as shown in FIG. 5A, or as a sealing ring, as shown in FIG. 5B. Alternatively or additionally, the seal 32, 32' can be continuous and arranged on the lower side 3 of the upper 1 of the shoe 50 or can be discontinuous and arranged discretely around each of the projections 11 of the chassis 10.

Apart from the form-fit to the projection 11, the stud 30 shown in FIG. 5A is anchored to the chassis 10 by means of the screw 31. It is possible to arrange the head of the screw 31 as either recessed into or flush with the stud 30, or as an additional profile element that extends beyond an exterior portion of the stud 30. In the embodiment shown in FIG. 5A, the screw 31 extends beyond the stud body 33 in a downward direction. In one embodiment, the screw 31 and in particular its head are made from a stable material(s), such as a metal or a highly stable plastic material to avoid becoming damaged, which could impair or render impossible the disassembly of the modular soccer shoe 50. Conversely, it is also possible to arrange only threads inside the stud 30, which are engaged by a screw or a similar mounting means extending from the chassis 10. It is also possible to use fundamentally different mounting means for the studs 30 without departing from the scope of the invention, for example as described above with respect to clipping or magnetic fixation.

In the embodiment of FIG. 5B, the stud 30' includes notches 35 on its perimeter that can be engaged by a suitable tool for mounting or detaching. To avoid wearing prematurely, the outermost region 34 of the stud 30' of this embodiment is made from a metal, preferably aluminum. Other materials, such as ceramics and suitable plastics, are also contemplated and within the scope of the invention.

Generally, the various components can be manufactured by, for example, injection molding or extrusion. Extrusion processes may be used to provide a uniform shape. Insert molding can then be used to provide the desired geometry of the open spaces, or the open spaces could be created in the desired locations by a subsequent machining operation. Other manufacturing techniques include melting or bonding portions together. For example, the projections 11 may be adhered to the chassis 10 with a liquid epoxy or a hot melt adhesive, such as EVA, or they may be formed integrally therewith. In addition to adhesive bonding, portions can be solvent bonded, which entails using a solvent to facilitate fusing of the portions.

In addition to the materials described hereinabove, the various components can also be manufactured from other suitable polymeric material or combination of polymeric materials, either with or without reinforcement. Suitable materials include: polyurethanes, such as TPU; EVA; thermoplastic polyether block amides, such as the Pebax® brand sold by Elf Atochem; thermoplastic polyester elastomers, such as the Hytrel® brand sold by DuPont; polyamides, such as nylon 12, which may include 10 to 30 percent or more glass fiber reinforcement; silicones; polyethylenes; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example rubber or metal alloys. Other suitable materials will be apparent to those skilled in the art. The specific materials used will depend on the particular application for which the shoe is designed, but generally should be sufficiently compression-resistant, supportive, and flexible to the extent necessary for a particular sport.

The described modular design of a soccer shoe in accordance with the invention offers individual modules (upper, chassis, and studs) that are interchangeable independently from each other, so that the player himself can combine modules to customize his shoe. A customer could, for example, interactively select the individual components on a website on the internet wherein the selected combination of modules or only single modules can subsequently be ordered. The components of the studded shoe in accordance with the invention can, however, also be sold by retail shops, thereby providing additional options for a custom manufacture of the components, in particular the chassis 10 and the upper 1, or individual replacement of worn modules. In addition, retail shops could collect used components of the described shoe, which due to its modular design, can easily be separated into its individual modules, which are made from substantially only one material (for example the upper being made from leather, the chassis being made from a composite material, and the studs being made from a metal). Accordingly, the studded shoe of the invention facilitates its own recycling.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A modular article of footwear, comprising:

an upper comprising a lower side having at least one aperture formed therein;

a chassis located proximate an interior surface of the lower side and comprising at least one mounting structure extending from a lower surface of the chassis, wherein a shape of the at least one mounting structure substantially corresponds to a shape of the at least one aperture; and at least one stud configured to releasably couple to the chassis and comprising a mounting structure having an inner recess that is shaped to substantially correspond to the shape of the at least one mounting structure of the chassis.

2. The modular article of footwear of claim 1, wherein the lower side of the upper is secured between the chassis and the at least one stud when the at least one stud is releasably coupled to the chassis.

3. The modular article of footwear of claim 1, wherein the at least one mounting structure extends through the at least one aperture and beyond a bottom surface of the upper.

4. The modular article of footwear of claim 1, further comprising at least one seal located on a bottom surface of the lower side of the upper.

5. The modular article of footwear of claim 4, wherein the at least one seal is positioned adjacent the at least one aperture.

6. The modular article of footwear of claim 1, further comprising at least one seal located on the at least one stud and configured to contact the lower side of the upper when the at least one stud is releasably coupled to the chassis.

7. The modular article of footwear of claim 1, wherein the at least one mounting structure comprises a recessed portion configured to releasably couple with a screw of the at least one stud.

8. The modular article of footwear of claim 7, wherein the screw comprises an additional profile element that extends beyond an exterior portion of the at least one stud.

9. A modular article of footwear, comprising:

a chassis comprising at least two mounting structures, wherein a first mounting structure of the at least two mounting structures comprises a first shape and a second mounting structure of the at least two mounting structures comprises a second shape, wherein the first shape differs from the second shape;

at least two studs, wherein a first stud of the at least two studs comprises a first shape that substantially corresponds to the first shape of the first mounting structure and is releasably coupled to the first mounting structure, and a second stud of the at least two studs comprises a second shape that substantially corresponds to the second shape of the second mounting structure and is releasably coupled to the second mounting structure; and an upper comprising a lower side, wherein the lower side of the upper is secured between the chassis and the at least two studs when the at least two studs are releasably coupled to the chassis;

wherein the shape of the at least two studs and the at least two mounting structures prevent rotation of the at least two studs with respect to the chassis.

10. The modular article of footwear of claim 9, wherein the first shape of the first stud and the first mounting structure is generally oblong.

11. The modular article of footwear of claim 9, wherein the second shape of the second stud and the second mounting structure is generally oblong.

12. The modular article of footwear of claim 9, wherein the first stud and the first mounting structure comprise a first color, and the second stud and the second mounting structure comprise a second color, wherein the first color differs from the second color.

13. The modular article of footwear of claim 9, wherein at least two apertures are formed in the lower side of the upper, and the at least two mounting structures extend through the at least two apertures and beyond a bottom surface of the upper.

14. The modular article of footwear of claim 9, wherein each of the at least two mounting structures comprise a recessed portion configured to releasably couple with a screw of each of the at least two studs.

* * * * *